United States Patent [19]

Aono

[11] Patent Number: 5,073,533

[45] Date of Patent: Dec. 17, 1991

[54] THERMAL TRANSFER IMAGE RECEIVING MATERIALS

[75] Inventor: Toshiaki Aono, Kanagawa, Japan

[73] Assignee: Fuji Photo Film Co., Ltd., Kanagawa, Japan

[21] Appl. No.: 420,442

[22] Filed: Oct. 12, 1989

[30] Foreign Application Priority Data

Oct. 14, 1988 [JP] Japan ..... 63-258566

[51] Int. Cl.[5] ..... B41M 5/035; B41M 5/26

[52] U.S. Cl. ..... 503/227; 8/471; 428/195; 428/341; 428/423.1; 428/474.4; 428/478.2; 428/478.4; 428/478.8; 428/480; 428/500; 428/522; 428/913; 428/914

[58] Field of Search ..... 8/471; 428/195, 478.2, 428/478.4, 478.8, 913, 914, 341, 423.1, 474.4, 480, 500, 522; 503/227

[56] References Cited

U.S. PATENT DOCUMENTS 4,474,859 10/1984 Oshima et al. ..... 428/913

FOREIGN PATENT DOCUMENTS 0133011 2/1985 European Pat. Off. ..... 503/227

0275100 7/1988 European Pat. Off. ..... 428/195

57-137191 8/1982 Japan ..... 503/227

60-38192 2/1985 Japan ..... 503/227

2180661 4/1987 United Kingdom ..... 503/226

OTHER PUBLICATIONS

Patent Abstracts of Japan, vol. 12, No. 222, Jun. 24, 1988.

Patent Abstracts of Japan, vol. 12, No. 78, Mar. 11, 1988.

Patent Abstracts of Japan, vol. 12, No. 98, Mar. 31, 1988.

*Primary Examiner*—Bruce H. Hess

*Attorney, Agent, or Firm*—Sughrue, Mion, Zinn, Macpeak & Seas

[57] ABSTRACT

A thermal transfer image receiving material is described, comprising a support having thereon at least one dye receiving layer which can accept a dye which migrates from a thermal transfer dye donating material as a result of heating, wherein said dye receiving layer comprises a water soluble binder having a dye accepting substance dispersed therein, and said water soluble binder is hardened by a hardening agent.

16 Claims, No Drawings

THERMAL TRANSFER IMAGE RECEIVING MATERIALS

FIELD OF THE INVENTION

The present invention concerns thermal transfer receiving materials for thermal transfer using thermomobile type dyes. More precisely, the present invention concerns thermal transfer receiving materials which have a high image quality and improved image storage stability, and which have improved suitability for production and film quality.

BACKGROUND OF THE INVENTION

Various information processing systems have been developed as a result of the rapid development which have taken place in the information industry in recent years. Methods of recording and apparatus compatible with these information processing systems have been developed and adopted. Thermal transfer recording methods, i.e., recording methods of this type, involve the use of, an apparatus which is light and compact, with which there is little noise, and which has excellent operability and maintenance characteristics. Moreover, since they also allow coloring to be achieved easily, these methods are the most widely used. Thermal transfer recording methods can be broadly classified into two types, namely thermofusion types and thermomobile types. In the latter case, a thermal transfer dye donating material which has, on a support, a dye donating layer which contains a binder and a thermomobile dye is laminated with a thermal transfer image receiving material, heat is applied from the support side of the dye donating material, the thermomobile dye is transferred to the recording medium (thermal transfer image receiving material) in the form of a pattern corresponding to the heat pattern which has been applied and an image is formed in this way.

Moreover, a thermomobile dye is, for example, a dye which can be transferred from a thermal transfer dye donating material to a thermal transfer image receiving material by sublimation or diffusion in a medium.

However, the following disadvantages are encountered with thermal transfer image receiving materials in which the thermomobile type thermal transfer recording method is employed.

(1) The polymers used in the receiving layer for the thermomobile dye are soluble in organic solvents and so an organic solvent system is used for the receiving layer coating liquid. Furthermore, the apparatus and vessels used in the manufacturing process must be cleaned with organic solvents. Hence, the apparatus used for preparing the coating liquid and the coating apparatus must be explosion-proof. Furthermore, organic solvents are very expensive when compared to water and so the production costs are increased. Moreover problems can arise with the health supervision of the operators.

(2) Polymers which soften or become rubber-like during thermal transfer are sometimes used as binders for receiving layers, or plasticizers may be used, in order to achieve high density images However, irregularities are produced at the transfer surface in the maximum density regions when these devices are used and this results in a loss of gloss. Moreover, the image tends to fade on long term storage of the thermal transfer image receiving material after a transfer has been made.

Furthermore, JP-A-57-137191 or JP-A-60-38192 (the term "JP-A" as used herein means an "unexamined published Japanese patent application) describes a thermal transfer image receiving material which is produced by coating on a support a mixture of latexes of a saturated polyester or a vinyl-series polymer with a water soluble binder such as hydroxyethyl cellulose. However, the above-mentioned publications do not describe the formation of bridge at the binder portion such as hydroxyethyl cellulose at all. The thermal transfer image receiving material as described in the publications is heat fused with a dye donating material in case of thermally transferring a dye. Further, the dye image having been formed on the image receiving material as described in the publications is apt to be re-transferred onto the other substances, or the mechanical strength of a layer on the image receiving material, on which the image has been formed is apt to decrease in the presence of water or moisture.

SUMMARY OF THE INVENTION

The above mentioned problems have been resolved by a thermal transfer image receiving material of the present invention which comprises a support having thereon at least one dye receiving layer which can accept a dye which migrates from a thermal transfer dye donating material as a result of heating, wherein said dye receiving layer comprises a water soluble binder having a dye accepting substance dispersed therein, and said water soluble binder is hardened by a hardening agent.

DETAILED DESCRIPTION OF THE INVENTION

In the present invention, the dye accepting substance is not coated as an organic solvent solution, as was the case in the past. Moreover, since the dye accepting substance is dispersed in a water soluble binder and the dispersion is coated, coating can be carried out using water as a solvent. Thus, there is no risk of explosion, the manufacturing costs can be markedly reduced and the adverse effects on operator health are greatly reduced. From the viewpoint of the conventional techniques, the fact that image which have a high transfer density can be obtained through such a step that a layer in which a dye accepting substance is dispersed in a water soluble binder, as in the case of the present invention, sufficiently accepts a thermomobile dye is completely unexpected. Furthermore, the images obtained using a thermal transfer image receiving material of the present invention have a further advantage in that the extent of fading of the image on long term storage is very slight. Further, because a water soluble binder has been hardened by a hardening agent, a thermal transfer image receiving material of the present invention is hard to be heat fused with a dye donating material in case of thermally transferring a dye, a dye image having been formed on the image receiving material of the present invention is hard to be re-transferred onto the other substances, and the mechanical strength of an image receiving layer according to the present invention is high in spite of the presence of water or moisture.

The present invention is described in more detail below.

No particular limitation is imposed upon the support which is used for the thermal transfer image receiving materials of the present invention, and any of the known supports, can be used. Materials in which the dispersability of the thermomobile dye is high can also be used as supports under the present invention.

Specific examples of suitable supports are described below.

(1) Synthetic papers supports (such as polyolefin and polystyrene based synthetic papers).

(2) Paper supports, such as top quality paper, art paper, coated paper, cast coated paper, wall paper, lining paper, papers which are impregnated with synthetic resins or emulsions, papers which are impregnated with synthetic rubber latexes, papers with added synthetic resins, cardboard, cellulose fiber papers and polyolefin coated papers (especially papers which have been covered on both sides with polyethylene).

(3) Various synthetic resin films or sheets made of synthetic resins such as polyolefins, poly(vinyl chloride), poly(ethylene terephthalate), polystyrene, methacrylate or polycarbonate, and films or sheets obtained by rendering these synthetic resins white and reflective.

Furthermore, laminates comprised of any combinations of (1) to (3) above can also be used.

Of these supports, polyolefin coated paper has the advantages of not giving rise to concave type deformations due to the heating during thermal transfer, excellent whiteness and exhibiting little curl, and the use of such supports is preferred.

Polyolefin coated papers described, for example, in "The Fundamentals of Photo-engineering, (Silver Salt Photography Edition)", Japanese Photography Society Publication, pages 223–240, published by Corona, 1979. The polyolefin coated papers comprise fundamentally a supporting sheet which has a layer of polyolefin coated on the surface. The supporing sheet is made from a material other than a synthetic resin and top quality paper is generally used. The polyolefin coat may be established using any method provided that the polyolefin layer is in intimate contact with the surface of the supporting sheet. Usually an extrusion process is employed. The polyolefin coated layer may be on the side of the supporting sheet on which the receiving layer is present but it may also be on both sides of the supporting sheet. High density polyethylene, low density polyethylene or polypropylene, for example, can be used as the polyolefin, and any polyolefin can be used for this purpose. However, the use of low density polyethylene which has a lower thermal conductivity is preferred on the side on which the receiving layer is present in view of the thermal insulating effect during transfer.

No particular limitation is imposed upon the thickness of the polyolefin coating, but a thickness of from 5 to 100 μm per side is usually preferred. However, thinner polyolefin coatings are preferred on the receiving layer side for providing higher transfer densities. Pigments and filters, such a titanium oxide and ultramarine, for example, may be added to the polyolefin coating to increase whiteness. Furthermore, a thin gelatin layer of about 0.05 to 0.4 g/m$^2$ may be established on the surface of the polyolefin coated paper (on the side of the receiving layer and/or the reverse side).

The receiving layers for the thermomobile dyes in the thermal transfer image receiving materials of the present invention have the function of taking up the thermomobile dyes which migrate from the thermal transfer sheet when printing is being carried out and of fixing the dye. These layers comprise layers which contain, diffused in a water soluble binder, substances (referred to hereinafter as accepting substances) which can accept the thermomobile dyes.

The accepting substance may be a polymer, a high boiling point organic solvent or a thermal solvent which is incompatible with water, for example, which can accept the various thermomobile dyes.

Resins such as those described below are suitable polymers which can accept thermomobile dyes. The resins preferably have an average molecular weight of 5,000 to 100,000.

(a) Resins which have Ester Bonds

Polyester resins, poly(acrylic acid ester) resins, polycarbonate resins, poly(vinyl acetate) resins, styrene/acrylate resins, and vinyltoluene/acrylate resins, for example. In practice, use can be made of the resins disclosed in JP-A-59-101395, JP-A-63-7971, JP-A-63-7972, JP-A-63-7973, and JP-A-60-294862. Furthermore, "Vylon 290", "Vylon 200", "Vylon 280", "Vylon 300", "Vylon 103", "Vylon GK-140" and "Vylon GK-130" made by Toyo Boseki, "ATR-2009" and "ATR-2010" made by Kao, "Unitika elitel ®"(a saturated polyester resin) made by UNITIKA, "Nichigo polyester" (a saturated copolymerized polyester resin) made by Nippon Synthemical Chemical, and "K-1080", "K-1294", "R-188", "R80" and "R70" (a saturated copolymerized polyester resin) made by Toray can be used and are commercially available.

(b) Resins which have Urethane Bonds

For example, polyurethane resins. "Nippolan 5032", "Nippolan 5033" and "Nippolan 5034" made by Nippon Polyurethane can be used and commercially available.

(c) Resins which have Amide Bonds

For example, polyamide resins.

(e) Resins which have Urea Bonds

For example, urea resins.

(f) Resins which have Other Highly Polar Bonds

For example, polycaprolactone resins, styrene/maleic anhydride resins, poly(vinyl chloride) resins and polyacrylonitrile resins.

The synthetic resins indicated above can be used individually, but they can also be used in the form of mixtures or copolymers, if desired.

The use of esters (for example, phthalate esters, phosphate esters and fatty acid esters), amides (for example, fatty acid amides and sulfoamides), ethers, alcohols, paraffins and silicone oils, which are liquids at normal temperatures and which do not volatalize at the heating temperature, is preferred for the high boiling point organic solvents which can accept thermomobile dyes. The high boiling point organic soluents preferably have a boiling point of at least 180° C., particularly at least 200° C. at an atmospheric pressure.

Compounds which have various properties, which is to say (1) which are compatible with thermomobile dyes but incompatible with water soluble binders, (2) which are solids at normal temperature but which melt (which may involve mixed melting with another component) when heated by the thermal head during transfer, and (3) which are not decomposed by the heat from the thermal head are preferred as the thermal solvents. Preferred compounds have a melting point of from 35° C. to 250° C., and most desirably of from 35° C. to 200° C., and are such that the value of the ratio (inorganic nature/organic nature) has a value of less than 1.5. Here, the assignation of an inorganic nature and an organic nature is a concept used for estimating the nature of compounds, and this has been described in detail, for example, in *The Realm of Chemistry*, 11, page 719 (1957).

Actual examples of high boiling point organic solvents and thermal solvents which can be used include the compounds disclosed, for example, in JP-A-62-174754. JP-A-62-245253, JP-A-61-209444, JP-A-61-200538, JP-A-62-8145, JP-A-62-9348, JP-A-62-30247 and JP-A-62-136646.

Specific examples of thermal solvents which can be used in the present invention include urea derivatives (e.g., dimethylurea, diethylurea, phenylurea, etc.), amido derivatives (e.g., acetamide, benzamido, etc.), polyhydric alcohols (e.g., 1,5-pentanediol, 1,6-pentanediol, 1,2-cyclohexanediol, pentaerythritol, trimethylolethane. etc.), polyethylene glycols, esters (e.g., phthalates, phosphates, fatty acid ester, etc.), amides (e.g., fatty acid amides, sulfamides, etc.). ethers, alcohols, paraffins, etc.. as described, for example, in U.S. Pat. Nos. 2,322,027, 2,533,514, and 2,882,157, JP-B-46-23233, British Patent 958,441 and 1,222,753, JP-A-50-82078, U.S. Pat. Nos. 2,353,262, 3,676,142 and 3,600,454, JP-A-51,28921, JP-A-51-141623, Japanese Patent Application No. 60-148489, etc. a saturated or unsaturated hydrocarbon having at least 10 carbon atoms (a part or all of the hydrogen atoms may be substituted with halogen atom(s)) or a compound represented by the following general formula (A), (B), (C), (D), (E), (F) or (G).

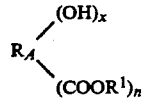

General Formula (A)

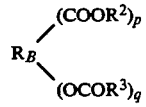

General Formula (B)

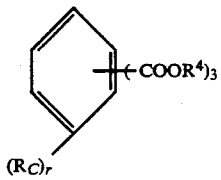

General Formula (C)

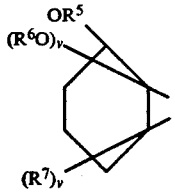

Zl

General Formula (D)

$(R^0-O)_3P=O$

General Formula (E)

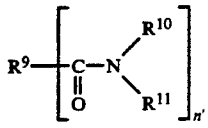

General Formula (F)

$R_G-COO-R^{12}$

General Formula (G)

In the aforementioned general formula (A), $R_A$ represents a substituted or unsubstituted aliphatic hydrocarbon group having a valency of m+n; $R^1$ represents a substituted or unsubstituted aliphatic hydrocarbon group, a substituted or unsubstituted alicyclic hydrocarbon group or a substituted or unsubstituted aromatic hydrocarbon group: and m and n each represents an integer of 1 to 5.

In the aforementioned general formula (B), $R_8$ represents a substituted or unsubstituted aliphatic hydrocarbon group having a valency of p+q or a substituted or unsubstituted alicyclic hydrocarbon group having a valency of p+q: $R^2$ and $R^3$, which may be the same, each represents a substituted or unsubstituted aliphatic hydrocarbon group or a substituted or unsubstituted alicyclic hydrocarbon group; and p represents 0, 1, 2 or 3, q represents 0, 1, 2 or 3 and p+q is at least 1.

In the aforementioned general formula (C), $R_c$ represents a hydrocarbon atom, or an aliphatic hydrocarbon group, an alicyclic hydrocarbon group, an aromatic hydrocarbon group, an acyl group, an amino group, an acyloxy group, a carbamoyl group, a ureido group, an alkoxycarbonyl group, an aryloxycarbonyl group or a cycloalkyloxycarbonyl group, which each may be substituted or unsubstituted, or a halogen atom, a hydroxyl group, a carboxyl group, a nitro group or a cyano group.

$R^4$ represents a substituted or unsubstituted aliphatic hydrocarbon group, a substituted or unsubstituted alicyclic hydrocarbon group or a substituted or unsubstituted aromatic hydrocarbon group.

r represents an integer of 1 to 5. s represents an integer of 1 to 4 and r+s is at most 6.

When r is at least 2, $R_c$'s may be the same or different.

When s is at least 2, $R^4$'s may be the same or different.

In the aforementioned general formula (D), $R^5$ and $R^6$ each represents a substituted or unsubstituted alkyl group, a substituted or unsubstituted, monocyclic or polycyclic alicyclic hydrocarbon group, a substituted or unsubstituted aryl group or a substituted or unsubstituted aralkyl group.

$R^7$ represents a substituted or unsubstituted alkyl group, a substituted or unsubstituted aryl group, a substituted or unsubstituted aralkyl group, a substituted or unsubstituted amino group or a halogen atom. Z represents an atomic group for forming a carbon ring which is condensed to a benzene ring.

l represents 0 or 1. v represents an integer of 0 to 2, w represents an integer of 0 to 7 and v+w is at most 7.

$R^6O$- and/or $R^7$- substitute on the benzene ring and/or the carbon ring condensed thereto in the aforementioned general formula (D).

In the aforementioned general formula (E), $R^8$ represents a substituted or unsubstituted alkyl group, a substituted or unsubstituted cycloalkyl group, a substituted or unsubstituted alkenyl group or a substituted or unsubstituted aryl group.

$R^8$ may be the same or different.

In the aforementioned general formula (F), $R^9$ represents a hydrogen atom or a substituted or unsubstituted aliphatic hydrocarbon group having a valency of n'.

$R^{10}$ or $R^{11}$ each represents a hydrogen atom, a substituted or unsubstituted aliphatic hydrocarbon group or a substituted or unsubstituted aromatic hydrocarbon group. $R^{10}$ or $R^{11}$ may be the same or different.

$R^9$ and $R^{10}$ or $R^{10}$ and $R^{11}$ may be linked with each other to form a hetero ring.

n' represents 1 or 2.

In the aforementioned general formula (G), $R_G$ represents a substituted or unsubstituted aliphatic hydrocarbon group, $R^{12}$ represents a substituted or unsubstituted aliphatic hydrocarbon group, a substituted or unsubstituted alicyclic hydrocarbon group or a substituted or unsubstituted aromatic hydrocarbon group.

The aforementioned general formulae (A) to (G) are described in detail in JP-A-59-178455, JP-A-59-178454, JP-A-59-178452, JP-A-59-178453, JP-A-59-178451, JP-A-59-178457, etc.

Specific examples of the compounds which can be used for constituting oil droplets are shown below.

(1) Liquid paraffin (2) Chlorinated paraffin

Liquid paraffin (1)

Chlorinated paraffin (2)

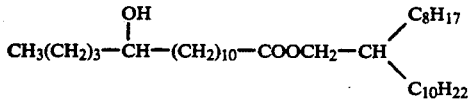
(3)

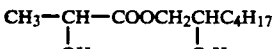
(4)

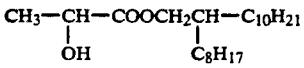
(5)

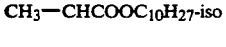
(6)

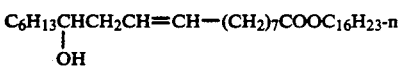
(7)

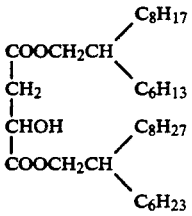
(8)

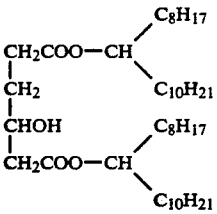
(9)

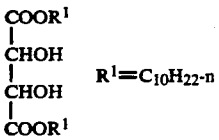
(10)

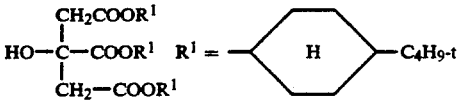
(11)

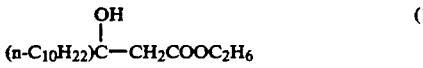
(12)

Further, the examples of the compounds represented by formula (A) include those described in Yushi-kagaku binran (the revised 2nd edition), 1971, (Maruzen), pp. 108–115 (Table 2-31, 2-34, 2-36, 2-39, 2-47).

(13) $C_{13}H_{27}COOC_{18}H_{37}$-iso

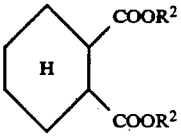
(13)

(14)

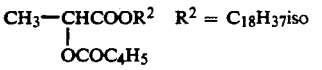
(15)

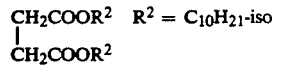
(16)

(17)

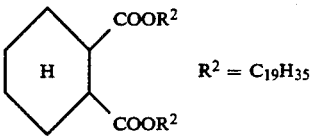
(18)

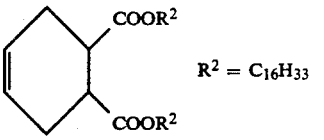
(19)

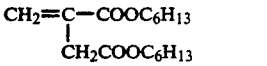
(20)

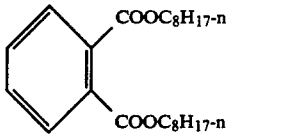
(21)

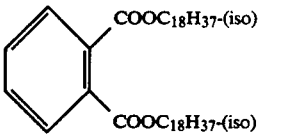
(22)

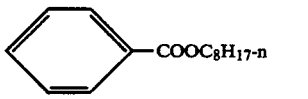
(23)

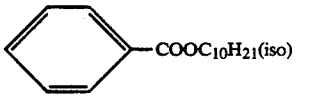
(24)

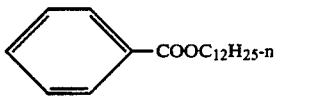
(25)

-continued (26)

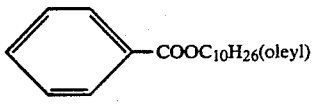

(27)

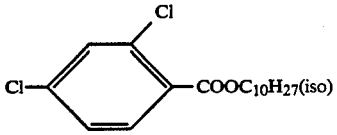

(28)

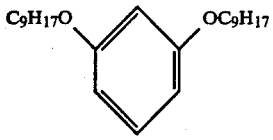

(29)

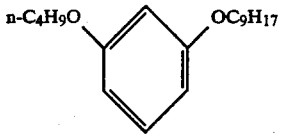

(30)

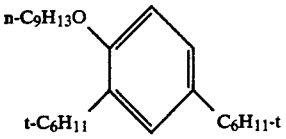

(31)

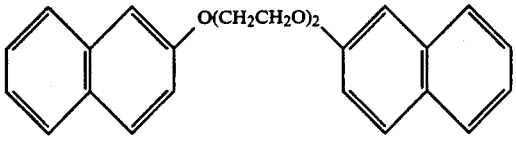

(32) $(C_4H_9)_3P{=}O$ (33)

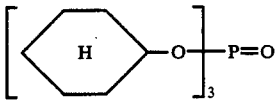

(34) $(C_8H_{17}O)_2P{=}O$

(35) $(iso\text{-}C_{10}H_{21})_3P{=}O$

(36) $(n\text{-}C_{10}H_{23}O)_2P{=}O$

(37) $(n\text{-}C_{10}H_{73}O)_2P{=}O$ (38)

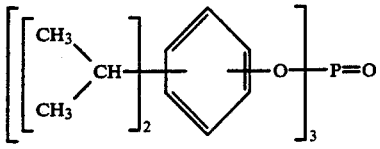

(39) $C_9H_{17}CH{=}CH(CH_2)_{22}CONH_2$ (40)

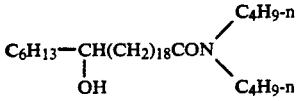

-continued (41)

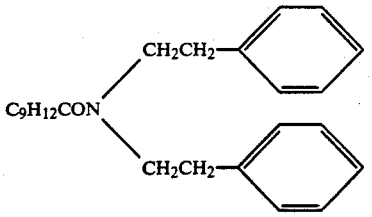

(42) $C_{12}H_{23}CON{+}C_2H_4OCH_3)_2$

These compounds are known, and they are available as a good on the market or can be easily synthesized according to the known synthesis methods.

The high boiling point organic solvents and/or thermal solvents can be used individually, but use in the form of mixtures with polymers which can accept thermomobile dyes is preferred.

The above mentioned accepting substances are used at a rate of from 0.5 to 20 grams, and preferably at a rate of from 1 to 10 grams per square meter of support.

Various binders can be used as the water soluble binder which is used in the dye receiving layers of the present invention. However, the use of water soluble polymers which have groups which can be crosslinked with hardening agents is preferred. The term "water soluble" means that at least 0.5 gram of the binder will dissolve in 100 ml of water at 0° C. to 60° C.

Examples of water soluble binders which can be used in the present invention include vinyl polymers and derivatives thereof, such as poly(vinyl alcohol), polyvinylpyrrolidone, poly(vinyl pyridinium) and cationic modified poly(vinyl alcohol) (see JP-A-60-145879, JP-A-60-220750, JP-A-61-143177. JP-A-61-235182, JP-A-61-245183, JP-A-237681, and JP-A-61-261089), polymers which contain acryl groups, such as polyacrylamide, polydimethylacrylamide, polydimethylaminoacrylate, poly(sodium acrylate), salts of acrylic acid/methacrylic acid copolymers, poly(sodium methacrylate) and salts of acrylic acid/vinyl alcohol copolymers (see JP-A-60-168651 and JP-A-62-9988), natural polymers or derivatives thereof, such as starch, oxidized starch, starch acetate, amine starch, carboxylated starch, dialdehyde starch, cationic starch, dextrin, sodium alginate, gelatin, gum arabic, casein, pullulan, dextran, methylcellulose, ethylcellulose, carboxymethylcellulose, hydroxyethylcellulose and hydroxypropylcellulose (see JP-A-59-174382, JP-A-60-262685, JP-A-61-143177, JP-A-61-181679, JP-A-61-193879 and JP-A-61-287782), synthetic polymers such as polyethylene glycol, polypropylene glycol, poly(vinyl methyl ether), maleic acid/vinyl acetate copolymers, maleic acid/N-vinylpyrrolidone copolymers, maleic acid/alkyl vinyl ether copolymers and polyethyleneimine (see JP-A-61-32787, JP-A-61-237680 and JP-A-61-277483, and the water soluble polymers disclosed in JP-A-56-58869.

Furthermore, various copolymers which have been rendered water soluble due to monomer components which contain $-SO_2^{\ominus}$ groups, $-COO^{\ominus}$ groups or $-SO_2^{\ominus}$ groups can also be used.

The use of gelatin for the water soluble binder is especially desirable since it can be set dried and imposes an particularly low drying load. In practice, use can be made of gelatins and gelatin derivatives such as lime-processed gelatins, lime-processed gelatins which have been subjected to a calcium removal treatment, acid-processed gelatins, phthalated gelatins, acetylated gelatins and succinated gelatins, and enzyme-processed gelatins, gelatin hydrolyzates and enzyme degradation products of gelatin such as those disclosed in *Bull. Soc. Phot. Japan,* No. 16, page 30 (1966).

These water soluble polymers can be used alone, or combinations of two or more types of polymers can be used.

The water soluble binder and the accepting substance are used in an accepting substance/water soluble binder ration (by weight) of from 1:1 to 20:1, preferably of from 2:1 to 10:1 and most desirably of from 2.5:1 to 7:1.

The receiving layers for the thermomobile dye of the present invention can be formed by coating on a support a coating solution prepared by adding a hardening agent to a dispersion of an accepting substance in an aqueous solution of a water soluble binder, with the addition of coating promotors, viscosity increasing agents, etc., as rquired.

Any of the known methods used for dispersing hydrophobic substances in water soluble polymers can be used to disperse the accepting substance in the water soluble binder. Typically, use is made of methods such as those in which a solution obtained by dissolving the accepting substance in an organic solvent which is immiscible with water is mixed with an aqueous solution of the water soluble binder and dispersed and emulsified, and those in which a latex of the accepting substance (polymer) is mixed with an aqueous solution of the water soluble binder. The former method is particularly preferred because it has, for example, an advantage that various improvements can be easily achieved by adding various additives to a phase of an accepting substance.

The receiving layer preferably has a layer structure comprised of at least two layers. In this case, synthetic resins which have a low glass transition point below 25° C., high boiling point organic solvents or thermal solvents are sometimes used in the layer closest to the support and a structure with good dye fixing properties for thermomobile dyes is obtained. Sometimes synthetic resins which have a higher glass transition point not less than 25° C. are used in the outermost layer with the use of a minimum amount of high boiling point organic solvent or thermal solvent, if required. This structure is desirable since there is no surface stickiness and no problem with sticking to other materials, retransfer to other materials after transfer or blocking of the thermal transfer dye donating materials.

The preferred overall thickness of the receiving layer is within the range from 1 to 50 μm, and most desirably within the range from 3 to 30 μm. In the case of a double layer structure, the preferred thickness of the outermost layer is within the range from 0.1 to 2 μm, and most desirably within the range from 0.2 to 1 μm.

The thermal transfer image receiving materials of the present invention may have an intermediate layer which does not contain a hydrophilic binder between the support and the receiving layer.

The intermediate layer is a layer which functions as a cushion layer, a porous layer or a layer which prevents the diffusion of thermomobile dyes, depending on the substance from which it is constructed, or is a layer which has two or more of these functions, and in some cases it may fulfill the role of an adhesive.

Layers for preventing the diffusion of thermomobile dyes prevent the thermomobile dye from diffusing into the support. The binder which is used to form these anti-diffusion layers may be water soluble or soluble in organic solvents, but water soluble binders are preferred. The use of water soluble binders, and especially gelatin, suggested for use as binders for the receiving layer as described earlier is most desirable.

Porous layers prevent heat which is applied during thermal transfer from diffusing from the receiving layer into the support and they ensure that the heat is used effectively.

The following methods may be used to form porous layers when a water soluble polymer is used for the binder in the porous layer: (1) Methods in which fine particles of a porous substance are dispersed in the water soluble polymer which is then coated and dried. (2) Methods in which a water soluble polymer solution in which bubbles have been formed by mechanical agitation is coated and dried. (3) Methods in which a solution of a water soluble polymer to which a foaming agent has been added is either foamed prior to coating and coated, or foamed during the coating/drying process. (4) Methods in which an organic solvent (preferably a solvent which has a higher boiling point than water) is emulsified and dispersed in a solution of the water soluble polymer and in which micro-voids are formed during the coating/drying process.

Where an organic solvent soluble binder is used for the porous layer, the porous layer can be formed using the following methods: (1) Methods in which a liquid consisting of a emulsion of a synthetic resin, such as polyurethane, for example, or a synthetic rubber latex, such as a methyl methacrylate/butadiene based synthetic rubber latex, which has been agitated mechanically to incorporate bubbles thereinto is coated onto a support and dried. (2) Methods in which a liquid obtained by mixing a foaming agent with the above mentioned synthetic resin emulsions or synthetic rubber latexes is coated onto a support and dried. (3) Methods in which a liquid obtained by mixing a foaming agent with a vinyl chloride plastisol, a synthetic resin such as polyurethane or a synthetic rubber such as a styrene/-butadiene based synthetic rubber is coated onto a support and foamed by heating. (4) Methods in which a liquid mixture of a solution obtained by dissolving a thermoplastic resin or a synthetic rubber in an organic solvent and a non-solvent (including those principally of water) which is less volatile than the organic solvent and compatible with the organic solvent, and in which the thermoplastic resin or synthetic rubber is not soluble, is coated onto the support and dried to form a microporous layer.

The intermediate layers may be present on both sides when receiving layers are present on both sides of the support, or they may be present only on one side. The thickness of an intermediate layer is from 0.5 to 50 μm, and most desirably from 1 to 20 μm.

Anti-static agents can be included in the receiving layer or on the surface thereof on at least one side of a thermal transfer image receiving material of the present invention. Examples of suitable anti-static agents include surfactants, for example, cationic surfactants (quaternary ammonium salts, polyamine derivatives, etc.), anionic surfactants (alkylphosphates, etc.), amphoteric surfactants and nonionic surfactants, and also metal oxides such as aluminum oxide and tin oxide, etc. In structures in which a receiving layer is only present on one surface, an anti-static agent may also be used on the opposite surface to that on which the receiving layer is present.

Fine powders of, for example, silica, clay, talc, diatomaceous earth, calcium carbonate, calcium sulfate, barium sulfate, aluminum silicate, synthetic zeolites, zinc oxide, lithophone or titanium oxide can also be added to the receiving layers, intermediate layers, protective layers, backing layers, etc. of the thermal transfer image receiving materials of the present invention.

The inclusion of fine silica powder in the water soluble binder of the receiving layer, particularly the outermost layer is desirable Here, the term "silica" signifies silicon dioxide or a substance where silicon dioxide is the principal component. The use of a material of average particle size from 10 to 100 mμ and specific surface area less than 250 $m^2/g$, and most desirably an average particle size from 10 to 50 mμ and a specific surface area from 20 to 200 $m^2/g$, is preferred for the fine silica powder which is present in a receiving layer. Furthermore, the amount of fine silica powder present is within the range from-5 to 90 wt %, and preferably within the range from 10 to 60 wt %, based on the total weight of the layer in which it is present.

Release agents may be included in the receiving layers, and especially in the outermost receiving layer, or a release agent layer may be formed over the receiving layer, in a thermal transfer image receiving material of the present invention in order to improve the release properties with respect to the thermal transfer dye donating material. Solid waxes, such as polyethylene wax, amide wax, Teflon powder, etc.; fluorine based and phosphate ester based surfactants; and silicone oils can be used as release agents, but the use of silicone oils is preferred. The silicone oils can be used in the form of oils but a silicone oil which is curable can be preferably used. The thickness of the release agent layer is from 0.01 to 5 μm, and preferably from 0.05 to 2 μm. The release agent layer may be formed by adding silicone oil to the receiving layer, coating them and then curing the silicone oil which subsequently bleeds out on the surface of the receiving layer.

Anti-color fading agents can also be included in the receiving layers described above in the present invention. Oil soluble anti-color fading agents are preferably dissolved in an organic solvent together with the accepting substance for the thermomobile dyes and emulsified and dispersed in the water soluble binder for inclusion in the receiving layer.

Suitable anti-color fading agents include antioxidant, ultraviolet absorbers and various metal complexes. Examples of antioxidants include chroman based compounds, coumarane based compounds, phenol based compounds (for example, hindered phenols), hydroquinone derivatives, hindered amine derivatives and spiroindane derivatives. The compounds disclosed in JP-A-61-1593644 are also effective in this connection.

Examples of appropriate ultraviolet absorbers include benzotriazole based compounds (for example, as disclosed in U.S. Pat. No. 3,533,794), 4-thiazolidone based compounds (for example, as disclosed in U.S. Pat. No. 3,352,681), benzophenone based compounds (for example, as disclosed in JP-A-46-2784), and other compounds disclosed, for example, in JP-A-54-48535, JP-A-62-136641 and JP-A-61-88256. Furthermore, the ultraviolet absorbing polymers disclosed in JP-A-62-260152 are also effective for this purpose.

Examples of metal complexes which can be used include the compounds disclosed, for example, in U.S. Pat. No. 4,241,155, columns 3–36 of U.S. Pat. No. 4,245,018, columns 3–8 of U.S. Pat. No. 4,254,195, JP-A-62-174741, pages 27–29 of JP-A-61-88256, Japanese Patent Application Nos. 62-234106, and 62-31096 (corresponding to JP-A-1-75568 and JP-A-63-199248, respectively), and Japanese Patent Application No. 62-230596.

Examples of useful anti-color fading agents are disclosed on pages 125–137 of JP-A-62-215272.

The above mentioned antioxidants, ultraviolet absorbers and metal complexes may be used in combinations, if desired.

Moreover, fluorescent whiteners can be included in the receiving layers used in the present invention. The compounds described, for example, in K. Veenkataraman, *The Chemistry of Synthetic Dyes,* Volume 5, Chapter 8, and those disclosed in JP-A-61-143752 are representative examples of fluorescent whiteners. Suitable fluorescent whiteners include stilbene based compounds, coumarin based compounds, biphenyl based compounds, benzoxazolyl based compounds, naphthalimide based compounds, pyrazoline based compounds, carbostyril based compounds, 2,5-dibenzoxazolylthiophene based compounds, etc. The fluorescent whiteners can be used in combination with anticolor fading agents, if desired.

The water soluble binder in the receiving layers according to the present invention is hardened with hardening agents. The intermediate layers, backing layers, etc. may be hardened with the hardening agents.

Suitable hardening agents which can be used in the present invention include aldehydes (for example, formaldehyde, glyoxal and glutaraldehyde), N-methylol compounds (for example, dimethylolurea and methylol-dimethylhydantoin), dioxane derivatives (for example, 2,3-dihydroxydioxane), active vinyl compounds (for example, 1,3,5-triacryloylhexahydro-s-triazine, bis(-vinylsulfonyl)methyl ether, N,N'-ethylenebis(vinylsulfonylacetamide) and N,N'-trimethylenebis(vinyl-sulfonylacetamide)), active halogen compounds (for example, 2,6-dichloro-6-hydroxy-s-triazine), mucohalic acids (for example, mucochloric acid and mucophenoxychloric acid), epoxy based compounds, iso-oxazoles, dialdehyde starch, and 1-chloro-6-hydroxytriazinylated gelatin. Specific examples of such compounds are disclosed, for example, in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,490,911, 3,539,644, and 3,543,292, British Patents 676,628, 825,544 and 1,270,578, West German Patents 872,153, 1,090,427 and 2,749,260, JP-B-34-7133 and JP-B-46-1872. (The term "JP-B" as used herein means an "examined Japanese patent publication".)

The use of aldehydes, active vinyl compounds and active halogen compounds is especially desirable as gelatin hardening agents.

Because the hardening agents as described above are mostly soluble in water, they can be directly added to a coating solution The oil soluble hardening agents such as isocyanates, etc. are dispersed together with an accepting substances in a water soluble binder and they can be used for hardening the water soluble binder on the interface between the dispersion of accepting substance and the water soluble binder.

In the present invention, although an amount of the hardening agents used for hardening an accepting layer is not particularly limited, the preferred amount is within the range from 0.1 to 20 wt %, particularly within the range from 1 to 10 wt %, based on the amount of water soluble binder.

The thermal transfer image receiving materials of the present invention are used in combination with thermal transfer dye donating materials.

The thermal transfer dye donating materials are fundamentally materials which have a thermal transfer layer which contains a thermomobile dye and binder on a support. The thermal transfer dye donating materials are formed by preparing a coating liquid by dissolving or dispersing a known thermomobile dye and a binder resin in a suitable solvent and coating this liquid at a rate so as to provide a dry film thickness of from about 0.2 to 5 μm, and preferably from 0.4 to 2 μm, for example, on one side of a support of the type used conventionally for thermal transfer dye donating materials and drying to form the thermal transfer layer.

Furthermore, anti-static layers as disclosed, for example, in EP-A-194106, and slip layers as disclosed, for example, in JP-A-62-51490 can be formed, as required.

Dyes which are useful for forming thermal transfer layers of this type include all of those dyes which have bee used conventionally in thermal transfer dye donating materials. However the use of dyes of low molecular weight, e.g. of about 150 to 800, is especially desirable in the present invention. The dyes are selected considering their transfer temperature, hue, light resistance and their solubility or diffusibility in inks and binder resins, etc.

Examples of suitable dyes include disperse dyes, basic dyes and oil soluble dyes, and examples of actual dyes which can be preferably used include "Sumicron Yellow E4GL", "Dyanics Yellow H2G-FS", "Miketone Polyether Yellow 3GSL", "Kayaset Yellow 937", "Sumicron Red EFBL", "Dyanics Red ACE", "Miketone Polyether Red FB", "Kayaset Red 126", "Miketone Fast Brilliant Blue B", and "Kayaset Blue 136".

Furthermore, use can be made of the yellow dyes disclosed, for example, in JP-A-59-78895, JP-A-60-28451, JP-A-60-28453, JP-A-60-53564, JP-A-61-148096, JP-A-60-239290, JP-A-60-31565, JP-A-60-30393, JP-A-60-53565, JP-A-60-27594, JP-A-61-262191, JP-A-60-152563, JP-A-61-244595, JP-A-62-196186, JP-A-63-142062, JP-A-63-39380, JP-A-62-290583, JP-A-63-111094, JP-A-63-111095, JP-A-63-122594, JP-A-63-71392, JP-A-63-74685, JP-A-63-74688 and Japanese Patent Application No. 63-51285 (corresponding to European Patent Application No. 89103666.7 or U.S. patent application Ser. No. 318,871 filed on Mar. 6, 1989). Japanese Patent Application No. 63-51285 describes these dyes represented by the following general formula (I):

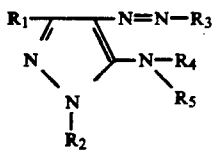

(I)

wherein $R_1$ represents a hydrogen atom, an alkyl group, an alkoxy group, an aryl group, an alkoxycarbonyl group, a cyano group or a carbamoyl group; $R_2$ represents a hydrogen atom, an alkyl group or an aryl group; $R_3$ represents an aryl group or a heterocyclic group; $R_4$ and $R_5$, which may be the same or different, each represents a hydrogen atom or an alkyl group; and the above mentioned groups may be further substituted.

Use can also be made of the magenta dyes disclosed, for example, in JP-A-60-223862, JP-A-60-28452, JP-A-60-31563, JP-A-59-78896, JP-A-60-31564, JP-A-60-303391, JP-A-61-227092, JP-A-61-227091, JP-A-60-30392, JP-A-60-30694, JP-A-60-131293, JP-A-61-227093, JP-A-60-159091, JP-A-61-262190, JP-A-62-33688, JP-A-63-5992, JP-A-61-12392, JP-A-62-55194, JP-A-62-297593, JP-A-63-74685, JP-A-63-74688, JP-A-62-97886, JP-A-62-62-132685, JP-A-61-163895, JP-A-62-211190, JP-A-62-99195 and Japanese Patent Application No. 62-220793 (corresponding to JP-A-1-63194 or U.S. patent application Ser. No. 239,580 filed on Sept. 1, 1988). Japanese Patent Application No. 62-220793 describes these dyes represented by the following general formula (II):

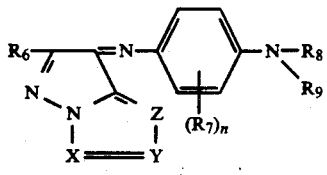

(II)

wherein $R_6$ and $R_7$, which may be the same or different, each represents a hydrogen atom, a halogen atom, an alkyl group, a cycloalkyl group, an alkoxy group, an aryl group, an aryloxy group, an aralkyl group, a cyano group, an acylamino group, a sulfonylamino group, a ureido group, an alkylthio group, an arylthio group, an alkoxycabonyl group, a carbamoyl group, a sulfamoyl group, a sulfonyl group, an acyl group or an amino group; and $R_8$ and $R_9$, which may be the same or different, each represents an alkyl group, a cycloalkyl group, an aralkyl group or an aryl group and $R_8$ and $R_9$ may also be joined together to form a ring, and rings may also be formed by $R_7$ and $R_8$, and by $R_7$ and $R_9$; n represents an integer of from 0 to 3; X, Y and Z each represents a

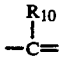

group or a nitrogen atom, where $R_{10}$ represents a hydrogen atom, an alkyl group, a cycloalkyl group, an aralkyl group, an aryl group, an alkoxy group, an aryloxy group or an amino group; further, when X and Y, or Y and Z are a

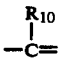

group they may be joined together to form a saturated or unsaturated carbocyclic ring; and the groups indicated above may be further substituted.

Use can also be made of the cyan dyes disclosed, for example, in JP-A-59-78894, JP-A-59-227490, JP-A-60-151098, JP-A-59-227493, JP-A-61-244594, JP-A-59-227948, JP-A-60-131292, JP-A-60-172591, JP-A-60-151097, JP-A-60-131294, JP-A-60-217266, JP-A-60-31559, JP-A-60-53563, JP-A-61-255897, JP-A-60-239289, JP-A-61-22993, JP-A-61-19396, JP-A-61-368493, JP-A-61-35994, JP-A-61-31467, JP-A-61-148269, JP-A-61-49893, JP-A-61-57651, JP-A-60-239291, JP-A-60-239292, JP-A-61-284489, JP-A-62-191191, JP-A-62-138291, JP-A-62-288656, JP-A-63-57293, JP-A-63-15853, JP-A-63-144089, JP-A-63-15790, JP-A-62-311190, JP-A-63-74685, JP-A-63-74688, JP-A-

62-132684, JP-A-62-87393, JP-A-62-255187 and Japanese Patent Application No. 62-175525 (corresponding to JP-A-1-20194 or U.S. patent application Ser. No. 218,789 filed on July 14, 1988). Japanese Patent Application No. 62-175525 describes these dyes represented by the following general formula (III):

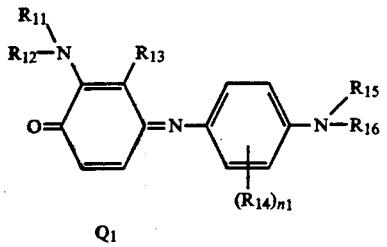

(III)

$Q_1$ wherein, $Q_1$ represents a group of atoms, including at least one nitrogen atom, required to form, together with the carbon atoms to which they are bound, a nitrogen containing heterocyclic ring which contains at least five atoms; $R_{11}$ represents an acyl group or a sulfonyl group; $R_{12}$ represents a hydrogen atom or an aliphatic group which has from 1 to 6 carbon atoms; $R_{13}$ represents a hydrogen atom, a halogen atom, an alkoxy group or an aliphatic group which has from 1 to 6 carbon atoms; $R_{14}$ represents a halogen atom, an alkoxy group or an aliphatic group which has from 1 to 6 carbon atoms; $n_1$ represents an integer of 0 to 4; $R_{13}$ may be joined to $R_{11}$, $R_{12}$ or $R_{14}$ to form a ring; $R_{15}$ and $R_{16}$, which may be the same or different, each represents a hydrogen atom, an aliphatic group which has from 1 to 6 carbon atoms, or an aromatic group; and $R_{15}$ and $R_{16}$ may also be joined together to form a ring, and further, $R_{15}$ and/or $R_{16}$ may be joined with $R_{14}$ to form a ring.

All of the well known binder resins used conventionally for this purpose in the past can be used as the binder resins which are used together with the dyes described above. The binder resin is usually selected to provide a high resistance to heat and properties such that the migration of the dye is not impeded when it is heated. For example, use can be made of polyamide based resins, polyester based resins, epoxy based resins, polyurethane based resins, polyacrylic resins (for example, poly(methyl methacrylate), polyacrylamide, polystyrene-2-acrylonitrile), vinyl based resins (for example, polyvinylpyrrolidone), poly(vinyl chloride) based resins (for example, vinyl chloride/vinyl acetate copolymers), polycarbonate based resins, polystyrene, poly(-phenylene oxide), cellulose based resins (for example, methylcellulose, ethylcellulose, carboxymethylcellulose, cellulose acetate hydrogen phthalate, cellulose acetate, cellulose acetate propionate, cellulose acetate butyrate, cellulose triacetate), poly(vinyl alcohol) based resins (for example, poly(vinyl alcohol) and partially saponified poly(vinyl alcohol)s such as poly(vinyl butyral), petroleum based resins, rosin derivatives, coumarone/indene resins, terpene based resins and polyolefin based resins (for example, polyethylene, polypropylene).

Binder resins of this type are preferably used at a rate, for example, of from about 80 to 600 parts by weight per 100 parts by weight of dye.

In the present invention, the ink solvents conventionally used can be used freely as ink solvents for the dissolution or dispersion of the above mentioned dyes and binder resins. Specific examples include alcohols such as methanol, ethanol, isopropyl alcohol, butanol and isobutanol, ketones such as methyl ethyl ketone, methyl isobutyl ketone and cyclohexanone, aromatic solvents such as toluene and xylene, halogenated solvents such as dichloromethane and trichloroethane, dioxane, and tetrahydrofuran, and mixtures of these solvents can also be used. These solvents are selected and used to provide at least the prescribed concentration of the dye which is being used and to provide a satisfactory dissolution or dispersion of the binder resin. For example, the use of an amount of solvent of about 9 to 20 times the total amount of dye and binder resin is desirable.

The thermal transfer dye donating materials obtained in the way described above are laminated with the thermal transfer image receiving materials of the present invention and heated in accordance with an image signal by means of a heating device such as a thermal head, for example, from either side, but preferably from the side opposite that of the thermal transfer dye donating material. As a result of this, the dye in the thermal transfer layer can be moved and transferred in accordance with the magnitude of the thermal energy applied, simply and with comparatively low energy, to the receiving layer of the thermal transfer image receiving material, and it is possible to obtain color images which have excellent sharpness and tone resolution.

Any supports conventionally known in the past can be used for the supports for the thermal transfer dye donating materials. For example, the support may be a polyester (for example, poly(ethylene terephthalate)), polyamide, polycarbonate, glassine paper, condenser paper, cellulose ester, fluoropolymer, polyether, polyacetal, polyolefin, polyimide, poly(phenylene sulfide), polypropylene, polysulfone or, cellophane support.

The support used for the thermal transfer dye donating material generally has a thickness from 2 to 30 μm. The supports may be covered with a subbing layer, as required. Furthermore, the reverse side may be covered with a slipping layer in order to prevent the thermal head from sticking to the support of the thermal transfer dye donating material. Slipping layers of this type consist of lubricating substances, such as surfactants, liquid lubricants, solid lubricants or mixtures of these materials, and the layers may or may not contain a polymer binder.

The receiving layers of a thermal transfer image receiving material of the present invention can be coated as aqueous solutions of water soluble binders and this is desirable from the viewpoint of safely during the coating and drying operations, operability, energy conservation of equipment, reduction in cost, etc. Set drying (drying after cooling to below the gelling temperature) can be achieved by using binders, such as gelatin, which can be gelled by a change in temperature as the water soluble binders and so the drying load can be reduced and simultaneous multi-layer coating can be achieved. This results in a considerably reduction in cost when manufacturing image receiving layers which have a multi-layer structure.

Moreover, high density images are obtained and fading of the image on long term storage can be suppressed.

Furthermore, the coated layer is not dissolved and there is no change in color of the image when water or an organic solvent accidentally contacts the surface of the thermal transfer image receiving materials of the present invention. Furthermore, anti-color fading agents can be dissolved easily and included in the dye accepting substances which are dispersed in the water soluble binder. In this way it is possible to achieve an adequate anti-color fading effect and prevent the precipitation of the anti-color fading agent at the surface of the image receiving material at the same time. Moreover, fluorescent whiteners can be included in the water soluble binder if they are water soluble or in the dye accepting substance if they are oil soluble, and whiteness can be improved in this way.

The following examples are given to further illustrate the present invention. Unless otherwise indicated all parts, percents, ratios and the like are by weight.

EXAMPLE 1

Preparation of Thermal Transfer Dye Donating Material (10)

A poly(ethylene terephthalate) film (S-PET, made by Toyo Boseki) of a thickness 6 μm, which had been subjected to a corona discharge treatment on one side, was used as a support. Coating Composition (A) for a dye donating layer described below was coated by wire bar coating on the surface of the support which had been subjected to the corona discharge and dried to form a layer of a dry thickness of 1 μm, and a heat resistant slip layer consisting of a thermoset acrylic resin was produced on the reverse side.

Coating Composition (A) for Dye Donating Layer

Disperse Dye (a): 4 grams

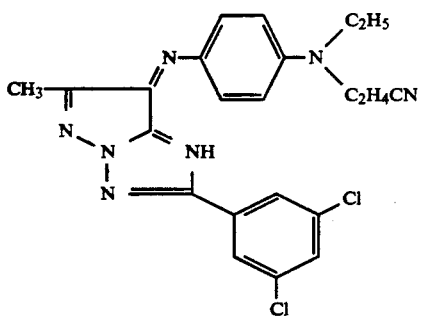

Poly(vinyl butyrate) Resin ("Denka Butyral 5000-A", made by Denki Kagaku: 4.3 grams
Toluene: 40 ml
Methyl Ethyl Ketone: 40 ml
Polyisocyanate ("Ketanate D110N, made by Takada Yakuhin): 0.2 ml Preparation of Thermal Transfer Image Receiving Material (20)

An organic solvent solution of a dye accepting polymer of Composition (B) shown below was emulsified and dispersed in the aqueous gelatin solution (A) described below using a homogenizer to prepare a gelatin dispersion of a dye accepting substance.

(A) Aqueous Gelatin Solution
Gelatin: 2.3 grams
Sodium Dodecylbenzensulfonate (5% aqueous solution): 20 ml
Water: 80 ml (B) Dye Accepting Polymer Solution
Polyester Resin ("Vylon 300", made by Toyo Boseki): 7.0 grams
Carboxy Modified Silicone Oil ("X-22-3710", made by Shinetsu Silicone): 0.7 grams
Methyl Ethyl Ketone: 20 ml
Toluene: 10 ml
Diphenyl Phthalate: 1.5 grams A solution obtained by dissolving 0.5 gram of the fluorine based surfactant (a), $$C_3F_7SO_2\underset{\underset{(C_3H_7)}{|}}{N}CH_2COOK,$$

in 10 ml of a water/methanol (1:1 by volume) mixture was added to the dispersion prepared in the manner described above to provide a receiving layer coating composition. This coating composition was coated using a wire bar coating method onto a synthetic paper ("YUPO-SGG-150", made by Oji Petrochemical) of a thickness of 150 μm, of which the surface had been subjected to a corona discharge, form a layer of a wet film thickness of 75 μm and then dried.

Thermal Transfer Dye Donating Material (10) and Thermal Transfer Image Receiving Material (20) were laminated together in such a way that the dye donating layer and the dye receiving layer were in contact and printing was carried out using a thermal head from the support side of the thermal transfer dye donating material under conditions of a thermal head output of 0.25 W/dot, a pulse width of 0.15 to 15 msec, a dot density of 6 dots/mm. Magenta dye was fixed in the receiving layer of the thermal transfer image receiving material in the form of the image.

The magenta transfer image obtained was subjected to reflection density measurement using an "X-Rite 310" (made by the X-Rite Co.) instrument and a value of 1.67 was obtained. Furthermore, the transfer image was uniform across the entire image and a good S/N ratio was achieved.

Furthermore, no fading of the image was observed after storing the sample for 2 weeks at 60° C.

EXAMPLE 2

Thermal Transfer Image Receiving Material (30) whose structure was as shown in Table 1 below was prepared. The gelatin dispersion of the polyester resin was prepared using the same procedure as described in Example 1. The hardening agent having been added in the first layer subjects a gelatin having been added in the second layer to hardening, with it being diffused from the first layer to the second layer.

Thermal Transfer Image Receiving Material (30) prepared in this way was combined with a Hitachi "VY-S100" thermal transfer dye donating material and thermal transfer was carried out using a color video printer VY-100 (made by Hitachi Seisakujo) which had a thermal head with a dot density of 6 dot/mm. A video picture which had a pattern with a continuous tone ranging from low density to high density was used as the image source. Furthermore, density measurements were made using the aforementioned X-Rite 310.

The maximum cyan, magenta and yellow densities were 1.93, 1.70 and 1.51, respectively, and the S/N ratio was good. Moreover the transfer image obtained had a smooth gradation.

TABLE 1

| Layer | Composition | |
|---|---|---|
| Second Layer | Gelatin | 1.3 g/m$^2$ |
| | Polyester Resin ("Vylon 300", made by Toyo Boseki) | 4 g/m$^2$ |
| | Surfactant (1)* | 0.5 g/m$^2$ |

TABLE 1-continued

| Layer | Composition | | |
|---|---|---|---|
| | Surfactant (2)* | | 0.5 g/m$^2$ |
| | Diphenyl Phthalate | | 1 g/m$^2$ |
| First Layer | Gelatin | | 1.0 g/m$^2$ |
| | Hardening Agent (1)* | | 0.1 g/m$^2$ |
| Support | Paper Laminated with Polyethylene (PE) on Both Sides | Surface: | PE Layer containing $TiO_2$ |
| | | Base Paper: | 150 g/m$^2$ |
| | | Back Surface: | PE Layer |

Surfactant (1)*: sodium dodecylbenzenesulfonate $$C_3H_7$$

Sulfactant (2)*: $C_8H_{17}SO_2NCH_2COOK$

Hardening Agent (1)*: $CH_2NHCOCH_2SO_2CH{=}CH_2$ $$CH_2NHCOCH_2SO_2CH{=}CH_2$$

EXAMPLE 3

Thermal Transfer Image Receiving Material (40) whose structure was as shown in Table 2 below was prepared. The gelatin dispersion of the polyester resin was prepared using the same procedure as described in Example 1. The hardening agent having been added in the first layer subjects a gelatin having been added in the second layer to hardening with it being diffused from the first layer to the second layer. The transfer of a video image and the density measurements were made in the same way as described in Example 2.

The maximum cyan, magenta and yellow densities of the color image obtained were 1.81, 1.58 and 1.43, respectively, and the S/N ratio was good. Moreover, the transfer image obtained had a good gradation.

TABLE 2

| Layer | Composition | | |
|---|---|---|---|
| Second Layer | Gelatin | | 1.25 g/m$^2$ |
| | Polyester Resin ("Vylon 300", made by Toyo Boseki) | | 5 g/m$^2$ |
| | Surfactant (1)* | | 0.5 g/m$^2$ |
| | Surfactant (2)* | | 0.5 g/m$^2$ |
| | Carboxy Modified Silicone Oil ("X-22-3710", made by Shinetsu Kagaku) | | 0.5 g/m$^2$ |
| First Layer | Gelatin | | 1.5 g/m$^2$ |
| | Hardening Agent (1)* | | 0.12 g/m$^2$ |
| Support | Paper Laminated with Polyethylene (PE) on Both Sides | Surface: | PE Layer containing $TiO_2$ |
| | | Base Paper: | 150 g/m$^2$ |
| | | Back Surface: | PE Layer |

Surfactant (1)*: sodium dodecylbenzenesulfonate $$C_3H_7$$

Sulfactant (2)*: $C_8H_{17}SO_2NCH_2COOK$

Hardening Agent (1)*: $CH_2NHCOCH_2SO_2CH{=}CH_2$ $$CH_2NHCOCH_2SO_2CH{=}CH_2$$

Further, after the transfer was carried out using Thermal Transfer Image Receiving Materials (20), (30) and (40) and the above described dye donating material by means of a thermal head under condition of a thermal head output of 0.3 W/dot, both materials were peeled apart from each other, and then the degree of heat fusion bond was observed. From the results, it can be seen that when Thermal Transfer Image Receiving Material (20) was used a part of a receiving layer thereon was peeled apart by the heat fusion bond with the dye donating material, but when Thermal Transfer Image Receiving Materials (30) and (40) were used receiving layers thereon were not peeled apart in the absence of heat fusion bond. Furthermore, the image receiving material (A) on which a transfer has been carried out was put upon an image receiving material (B) on which transfer has not been carried out in such a manner that image receiving layers on both materials were contacted face to face, and thus obtained sample was stored for 3 days at 50° C., with a weight of 500 g being put on the sample. Both materials of the sample were peeled apart from each other and the degree of re-transfer was observed. From the results, it can be seen that when Thermal Transfer Image Receiving Material (20) was used a dye was re-transferred from the image receiving material (A) to the image receiving material (B) and the image density on the image receiving material (A) was decreased, but when Thermal Transfer Image Receiving Materials (30) and (40) were used such re-transfer did not occur at all.

While the invention has been described in detail and with reference to specific embodiments thereof, it will be apparent to one skilled in the art that various changes and modifications can be made therein without departing from the spirit and scope thereof.

What is claimed is:

1. A thermal transfer image receiving material comprising a support having thereon at least one dye receiving layer which can accept a dye which migrates from a thermal transfer dye donating material as a result of heating, wherein said dye receiving layer comprises a water soluble binder having a dye accepting substance dispersed therein, and said water soluble binder is hardened by a hardening agent.

2. The thermal transfer image receiving material of claim 1, wherein the dye accepting substance is a polymer, a high-boiling point organic solvent or a thermal solvent which is incompatible with water.

3. The thermal transfer image receiving material of claim 2, wherein the polymer is an ester bond containing resin, a urethane bond containing resin, an amide bond containing resin, a urea bond containing resin or a highly polar bond containing resin.

4. The thermal transfer image receiving material of claim 2, wherein the high-boiling point organic solvent is an ester, an amide, an ether, an alcohol, a paraffin or a silicone oil.

5. The thermal transfer image receiving material of claim 2, wherein the thermal solvent is a compound which is compatible with a dye but incompatible with a water-soluble binder, which is a solid at normal temperature but which melts when heated and which is not decomposed by heat during thermal activation.

6. The thermal transfer image receiving material of claim 5, wherein the thermal solvent is a compound having a melting point of from 35° C. to 250° C. and where the inorganic nature/organic nature ratio is less than 1.5.

7. The thermal transfer image receiving material of claim 1, wherein the water-soluble binder is a acryl group containing polymer, a natural polymer, a polyethylene glycol, a polypropylene glycol, a poly(vinyl methyl ether), a maleic acid/vinyl acetate copolymer, a maleic acid/N-vinylpyrrolidone copolymer, a maleic acid/alkyl vinyl ether copolymer or a polyethyleneimine.

8. The thermal transfer image receiving material of claim 1, wherein the water-soluble binder is a vinyl polymer.

9. The thermal transfer image receiving material of claim 1, wherein the dye accepting substance is present in an amount of from 0.5 to 20 grams per square meter of support and the weight ratio of the dye accepting substance to the water-soluble binder is 1:1 to 20:1.

10. The thermal transfer image receiving material of claim 1, wherein the hardening agent is aldehydes, N-methylol compounds, dioxane derivatives, active vinyl compounds, active halogen compounds, mucohalic acids, epoxy based compounds, iso-oxazoles, dialdehyde starch or 1-chloro-6-hydroxytriazinylated gelatin.

11. The thermal transfer image receiving material of claim 10, wherein the hardening agent is aldehydes, active vinyl compounds or active halogen compounds.

12. A thermal recording material comprising the thermal transfer image receiving material of claim 1 and additionally a thermal transfer dye donating material comprising a dye donating layer comprising a thermomobile dye and a binder provided on a support, wherein the dye donating layer faces and is in contact with the thermal transfer image receiving layer of the thermal transfer image receiving material.

13. A thermal transfer image receiving material as in claim 1, wherein said dye accepting substance is a polymer or a high-boiling organic solvent.

14. A thermal transfer image receiving material comprising a support having thereon at least one dye receiving layer which can accept a dye which migrates from a thermal transfer dye donating material as a result of heating, wherein said dye receiving layer comprises a water soluble binder having a dye accepting substance dispersed therein, and said water soluble binder is hardened by a hardening agent, wherein said dye accepting substance is a thermal solvent, and wherein said thermal solvent is a compound which is compatible with a dye but incompatible with a water-soluble binder, which is a solid at normal temperature but which melts when heated and which is not decomposed by heat during thermal activation.

15. A thermal transfer image receiving material comprising a support having thereon at least one dye receiving layer which can accept a dye which migrates from a thermal transfer dye donating material as a result of heating, wherein said dye receiving layer comprises a water soluble binder having a dye accepting substance dispersed therein, and said water soluble binder is hardened by a hardening agent, wherein said dye accepting substance is a thermal solvent, and wherein the thermal solvent is a compound which is compatible with a dye but incompatible with a water-soluble binder, is a solid at normal temperature but melts when heated, is not decomposed by heat during thermal activation and is a compound having a melting point of from 35° C. to 250° C., and where the inorganic nature/organic nature ratio is less than 1.5.

16. A thermal transfer image receiving material comprising a support having thereon at least one dye receiving layer which can accept a dye which migrates from a thermal transfer dye donating material as a result of heating, wherein said dye receiving layer comprises a water soluble binder having a dye accepting substance dispersed therein, and said water soluble binder is hardened by a hardening agent, wherein aid water soluble binder is a gelatin derivative selected from the group consisting of lime-processed gelatins, lime-processed gelatins which have been subjected to a calcium removal treatment, acid-processed gelatins, phthalated gelatins, acetylated gelatins and succinated gelatins, and enzyme-processed gelatins, gelatin hydrolyzates and enzyme degradation products of gelatin.

* * * * *